US007417380B2

(12) United States Patent
Lee et al.

(10) Patent No.: US 7,417,380 B2
(45) Date of Patent: Aug. 26, 2008

(54) ELECTRON EMISSION DEVICE

(75) Inventors: Seung-Hyun Lee, Suwon-si (KR); Cheol-Hyeon Chang, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 11/351,473

(22) Filed: Feb. 9, 2006

(65) Prior Publication Data

US 2006/0220584 A1 Oct. 5, 2006

(30) Foreign Application Priority Data

Mar. 31, 2005 (KR) ..... 10-2005-0026985

(51) Int. Cl.
*G09G 3/10* (2006.01)

(52) U.S. Cl. ..... 315/169.4; 345/75.2; 345/67

(58) Field of Classification Search ... 315/169.1–169.4; 313/395, 498, 385–386, 494, 502–503, 506; 345/76, 67, 75.2, 84

See application file for complete search history.

(56) References Cited

U.S. PATENT DOCUMENTS

| | | | | |
|---|---|---|---|---|
| 5,346,683 | A | 9/1994 | Green et al. | 315/169.1 |
| 5,404,070 | A | 4/1995 | Tsai et al. | 315/169.3 |
| 5,528,103 | A | 6/1996 | Spindt et al. | 315/169.3 |
| 5,633,561 | A | 5/1997 | Barker | 315/169.3 |

(Continued)

FOREIGN PATENT DOCUMENTS

EP 1 329 927 A1 7/2003

(Continued)

OTHER PUBLICATIONS

Patent Abstracts of Japan for Publication No. 2000-036243; Date of Publication Feb. 2, 2000; in the name of Kamimura et al.

(Continued)

*Primary Examiner*—Douglas W. Owens
*Assistant Examiner*—Jimmy Vu
(74) *Attorney, Agent, or Firm*—Christie, Parker & Hale, LLP

(57) ABSTRACT

An electron emission device has an optimized inner structure where the electrons emitted from the electron emission regions are straightly migrated toward the phosphor layers. The electron emission device includes first and second substrates facing each other, and cathode electrodes formed on the first substrate. Electron emission regions are formed on the cathode electrodes. An insulating layer and gate electrodes are formed on the cathode electrodes and have openings exposing the electron emission regions. Phosphor layers are formed on the second substrate. An anode electrode is formed on a surface of the phosphor layers. The distance z between the cathode and the anode electrodes satisfies the following condition:

$$0.7d((Va-Vc)/Vg) \leqq z \leqq 1.4d((Va-Vc)/Vg),$$

where Vc indicates the voltage applied to the cathode electrodes, Vg the voltage applied to the gate electrodes, Va the voltage applied to the anode electrode, and d the distance between the cathode and the gate electrodes.

15 Claims, 10 Drawing Sheets

U.S. PATENT DOCUMENTS

| | | | | |
|---|---|---|---|---|
| 5,645,462 | A | 7/1997 | Banno et al. | 313/495 |
| 5,729,087 | A | 3/1998 | Chien | 313/495 |
| 6,057,637 | A | 5/2000 | Zettl et al. | 313/495 |
| 6,097,138 | A * | 8/2000 | Nakamoto | 313/309 |
| 6,201,343 | B1 | 3/2001 | Spindt et al. | 315/169.1 |
| 6,486,599 | B2 | 11/2002 | Wang et al. | 313/495 |
| 6,617,798 | B2 * | 9/2003 | Lee et al. | 315/169.3 |
| 6,621,232 | B2 * | 9/2003 | Jo et al. | 315/169.3 |
| 6,624,566 | B2 | 9/2003 | Uemura et al. | 345/183 |
| 6,703,791 | B2 * | 3/2004 | Azuma | 315/169.3 |
| 6,833,086 | B2 | 12/2004 | Kajiwara | 252/301.6 |
| 6,956,334 | B2 * | 10/2005 | Oh | 315/169.3 |
| 7,064,493 | B2 * | 6/2006 | Konishi | 315/169.1 |
| 7,227,311 | B2 * | 6/2007 | Tsukamoto | 315/169.3 |
| 2001/0030507 | A1 | 10/2001 | Ono | 313/504 |
| 2002/0127169 | A1 | 9/2002 | Smalley et al. | 313/498 |
| 2003/0141179 | A1 | 7/2003 | Yu et al. | 345/76 |
| 2004/0066132 | A1 | 4/2004 | Gao et al. | 378/122 |
| 2004/0070326 | A1 | 4/2004 | Mao et al. | 313/495 |
| 2004/0108515 | A1 | 6/2004 | Muroyama et al. | 438/20 |
| 2004/0173818 | A1 | 9/2004 | Cheng | 315/169.1 |
| 2004/0256975 | A1 | 12/2004 | Gao et al. | 378/122 |
| 2005/0023950 | A1 | 2/2005 | Yoon et al. | 315/169.3 |
| 2005/0127030 | A1 | 6/2005 | Watanabe et al. | 315/169.3 |
| 2005/0234263 | A1 | 10/2005 | Prato et al. | 315/169.3 |

FOREIGN PATENT DOCUMENTS

| | | |
|---|---|---|
| JP | 10-125215 | 5/1998 |
| JP | 2000-36243 | 2/2000 |
| JP | 2000-123712 | 4/2000 |
| JP | 2000-223004 | 8/2000 |
| JP | 2004-134185 | 4/2004 |
| JP | 2005-56818 | 3/2005 |

OTHER PUBLICATIONS

Patent Abstracts of Japan for Publication No. 2000-123712; Date of Publication Apr. 28, 2000; in the name of Baba et al.
Patent Abstracts of Japan for Publication No. 2000-223004; Date of Publication Aug. 11, 2000; in the name of Jin et al.
Patent Abstracts of Japan, Publication No. 10-125215, dated May 15, 1998, in the name of Hideo Makishima.
Patent Abstract of Japan, Publications No. 2004-134185, dated Apr. 30, 2004, in the name of Junko Yotani et al.
Patent Abstract of Japan, Publications No. 2005-056818, dated Mar. 3, 2005, in the name of Taiitsu In et al.

* cited by examiner

ELECTRON EMISSION DEVICE

CROSS REFERENCE TO RELATED APPLICATION

This application claims priority to and the benefit of Korean Patent Application No. 10-2005-0026985 filed on Mar. 31, 2005 in the Korean Intellectual Property Office, the entire content of which is incorporated herein by reference.

BACKGROUND OF THE INVENTION

1. Field of the Invention

The present invention relates to an electron emission device, and in particular, to an electron emission device which has cathode and gate electrodes for controlling the emission of electrons from electron emission regions, and an anode electrode for accelerating the electrons.

2. Description of Related Art

Generally, electron emission devices are classified into a first type where a hot cathode is used as an electron emission source and a second type where a cold cathode is used as the electron emission source.

The second type of electron emission device may be a field emitter array (FEA) type, a surface-conduction emission (SCE) type, a metal-insulator-metal (MIM) type, or a metal-insulator-semiconductor (MIS) type.

The FEA-type electron emission device is based on the principle that when a material having a low work function or a high aspect ratio is used as an electron emission source, electrons are easily emitted from the electron emission source when an electric field is applied thereto under a vacuum atmosphere. A front sharp-pointed tip structure based on molybdenum (Mo) or silicon (Si), or a carbonaceous material such as graphite, has been applied for use as the electron emission source.

In common FEA-type electron emission devices, a first substrate and a second substrate make up a vacuum container. Electron emission regions are formed on the first substrate together with cathode and gate electrodes functioning as the driving electrodes for controlling the electron emission. Phosphor layers are formed on a surface of the second substrate facing the first substrate together with an anode electrode for keeping the phosphor layers in a high potential state.

The cathode electrodes are electrically connected to the electron emission regions to apply thereto the electric current required for electron emission, and the gate electrodes form electric fields around the electron emission regions using the voltage difference thereof from the cathode electrodes. In relation to the structure of the cathode and gate electrodes and the electron emission regions, the gate electrodes are placed over the cathode electrodes while interposing an insulating layer, and openings are formed at the gate electrodes and the insulating layer partially exposing the surface of the cathode electrodes. The electron emission regions are placed on the cathode electrodes within the openings.

With the above structure, predetermined voltages are applied to the cathode, gate, and anode electrodes to emit electrons from the electron emission regions. The electrons can be straightly migrated toward the second substrate without spreading only when an even potential distribution is made around the gate electrodes over the electron emission regions.

The even potential distribution means that, when viewing a side elevation view of the cathode and gate electrodes and the electron emission regions, the equipotential lines existing between the cathode and gate electrodes are located parallel to the top surface of the first substrate while being evenly spaced apart from each other by a predetermined distance. Equipotential lines not satisfying such a condition are considerably convex or concave in any one direction, so even potential distribution is not realized.

According to the operation principle of a known electronic lens, when the electrons pass through the interior of the electric field, the direction of electron migration is determined by the vector composition of the direction of electron migration and the direction of force (opposite to the direction of the electric field). In this regard, when a concave potential distribution directed toward the electron emission regions is formed around the gate electrodes, the electrons are considerably spread while passing through the openings of the gate electrodes. When a convex potential distribution directed toward the electron emission regions is formed around the gate electrodes, the electrons are focused while passing through the openings of the gate electrodes. However, the electrons are soon over-focused on the subsequent migration route, so that beam spreading also significantly occurs.

Accordingly, with the common FEA-type electron emission device, the potential distribution around the gate electrodes should be made as even as possible.

However, a considerable technical difficulty is encountered in making the even potential distribution because the potential distribution depends upon various factors, such as the voltages applied to the cathode, gate and anode electrodes, and the shape characteristic of the interior structure. As those factors also largely depend upon the discharge current characteristic of the electron emission regions, the screen brightness, and the processing capacity. There are technical limitations to optimizing the respective factors and to obtain the even potential distribution.

Consequently, with the conventional FEA-type electron emission device, a non-even potential distribution, that is, a convex or concave potential distribution directed toward the electron emission regions, is made around the gate electrodes during the operation thereof. The electrons emitted from the electron emission regions are spread while proceeding toward the second substrate, and land on black layers or incorrect phosphor layers, thereby deteriorating the screen display quality.

SUMMARY OF THE INVENTION

In one exemplary embodiment of the present invention, there is provided an electron emission device which makes an even potential distribution around the gate electrodes, thereby inhibiting the spreading of electron beams and thus enhancing the display quality.

In one embodiment of the present invention, the electron emission device includes a first substrate and a second substrate facing the first substrate. Cathode electrodes are formed on the first substrate. Electron emission regions are formed on the cathode electrodes. An insulating layer and gate electrodes are formed on the cathode electrodes and have openings exposing the electron emission regions. Phosphor layers are formed on the second substrate. An anode electrode is formed on a surface of the phosphor layers. The electron emission device satisfies one or both of the following conditions:

$$0.7d((Va-Vc)/Vg) \leqq z \leqq 1.4d((Va-Vc)/Vg) \quad (1); \text{ and}$$

$$0.7d((Va-Vc)/Vg) \leqq z' \leqq 1.4d((Va-Vc)/Vg) \quad (2),$$

where z indicates the distance between the cathode and the anode electrodes, z' the distance between the first and second substrates, Vc is the voltage applied to the cathode electrodes, Vg is the voltage applied to the gate electrodes, Va is the voltage applied to the anode electrode, and d is the distance between the cathode and the gate electrodes. The voltages Vc, Vg, and Va are expressed by the unit of volts (V), and the distances d, z, and z' are expressed by the unit of micrometers (μm).

The cathode and gate electrodes are perpendicular to each other and cross in crossed regions. One or more electron emission regions are provided per respective crossed regions of the cathode and gate electrodes.

The electron emission regions in some embodiments include at least one material selected from the group consisting of carbon nanotube, graphite, graphite nanofiber, diamond, diamond-like carbon, $C_{60}$, and silicon nanowire.

The anode electrode may be formed on a surface of the phosphor layers that faces the first substrate, and may be formed with a metallic material.

DETAILED DESCRIPTION

Figure 1:
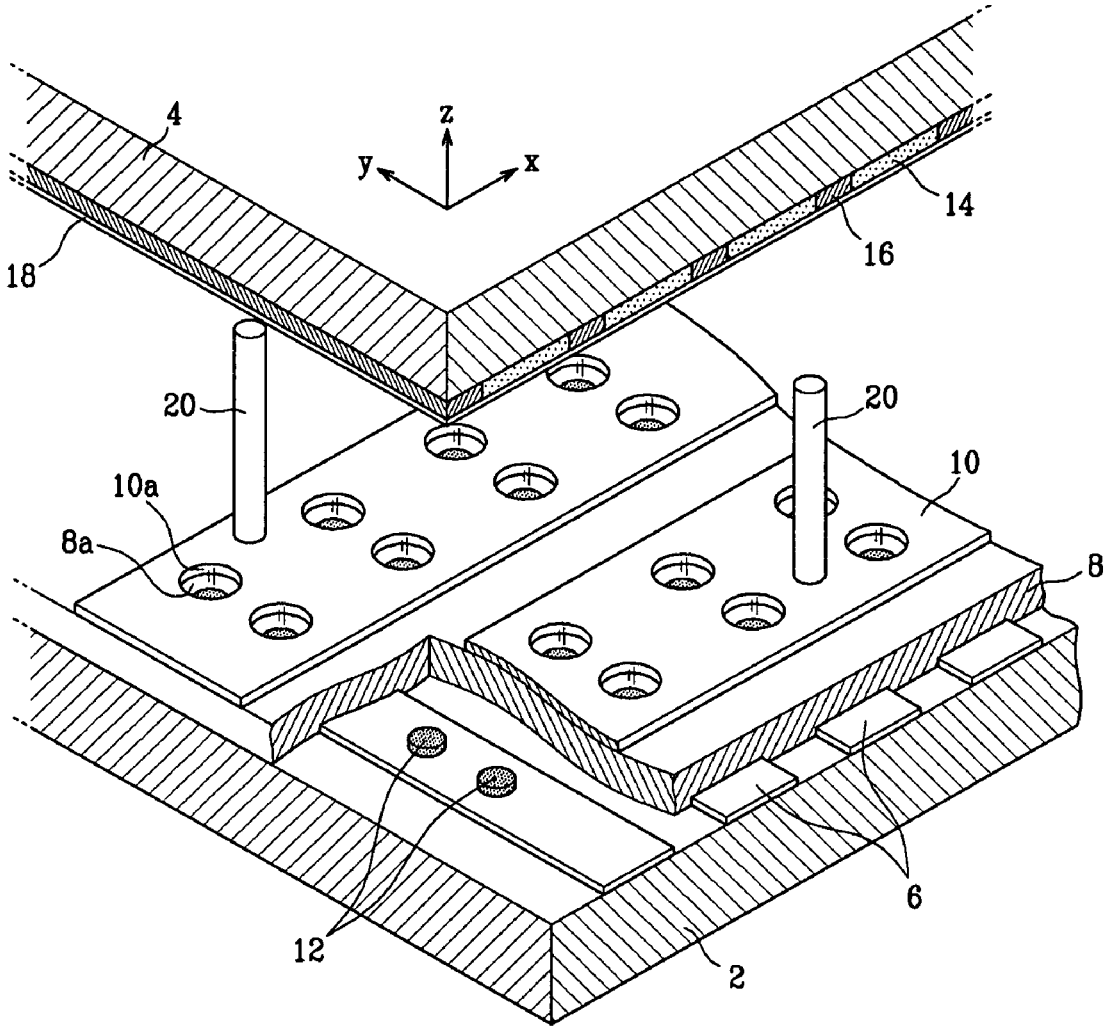
FIG. 1 is a partial exploded perspective view of an electron emission device according to an embodiment of the present invention.
Figure 2:
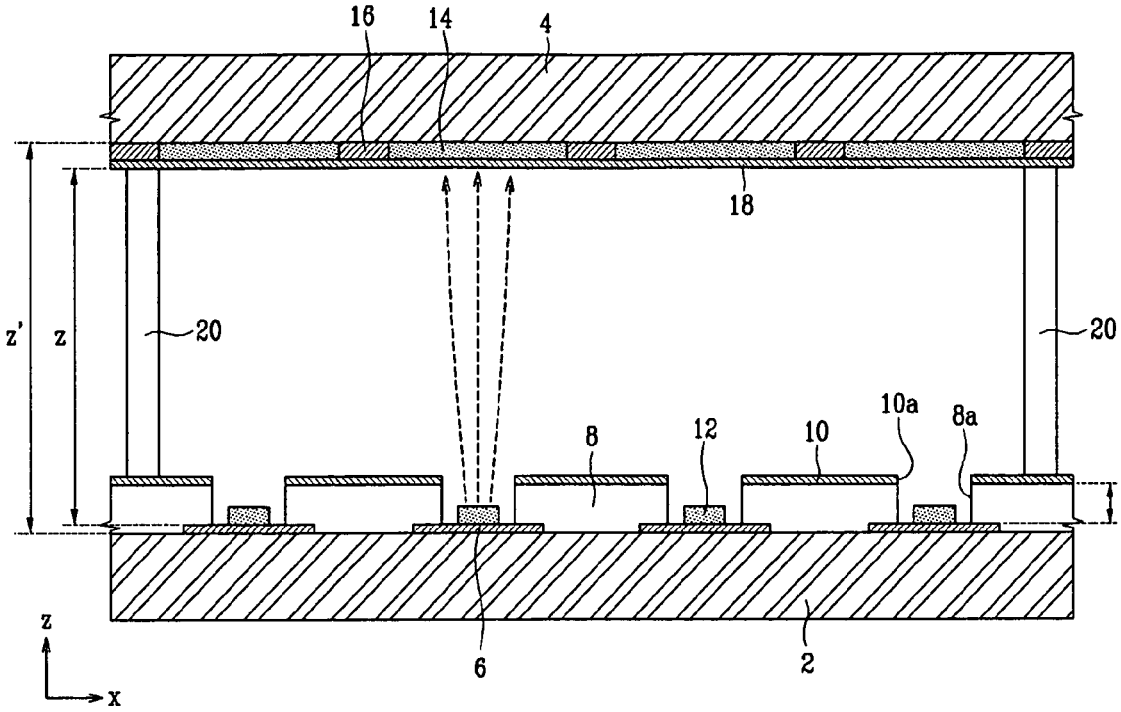
FIG. 2 is a partial sectional view of the electron emission device according to the embodiment of the present invention.

As shown in FIGS. 1 and 2, an electron emission device includes first and second substrates 2 and 4 arranged parallel to each other with an inner space. An electron emission structure is formed at the first substrate 2, and a light emission or display structure is formed at the second substrate 4 to emit visible rays due to the electrons, and display an image.

Cathode electrodes 6 are stripe-patterned on the first substrate 2 along the first substrate 2 (in the direction of the y axis of the drawing), and an insulating layer 8 is formed on the entire surface of the first substrate 2 while covering the cathode electrodes 6. Gate electrodes 10 are stripe-patterned on the insulating layer 8 perpendicular to the cathode electrodes 6 (in the direction of the x axis of the drawing).

In this embodiment, when the crossed regions of the cathode and the gate electrodes 6 and 10 are defined as pixel regions, one or more electron emission regions 12 are formed on the cathode electrodes 6 at the respective pixel regions, and openings 8*a* and 10*a* are formed in the insulating layer 8 and the gate electrodes 10 corresponding to the respective electron emission regions 12, thereby exposing the electron emission regions 12 on the first substrate 2.

The electron emission regions 12 are formed with a material that emits electrons when an electric field is applied thereto under the vacuum atmosphere, such as a carbonaceous material and a nanometer-sized material. The electron emission regions 12 may be formed with carbon nanotube, graphite, graphite nanofiber, diamond, diamond-like carbon, $C_{60}$, silicon nanowire, or any suitable combination thereof. The electron emission regions 12 may be formed through screen printing, direct growth, chemical vapor deposition, or sputtering.

Compared to the so-called spindt-type tip structure with a sharp-pointed front end, the electron emission regions 12 are formed with an electron emission layer where nanometer or micrometer-sized electron emission particles are conglomerated, and involve a larger electron emission area and easy processing.

As illustrated in the drawings, the electron emission regions 12 are shaped as a circle, and linearly arranged along the length of the cathode electrodes 6 at the respective pixel regions. However, the shape, number per pixel, and arrangement of the electron emission regions 12 are not limited to this illustration, but may be altered in various manners.

Phosphor layers 14 and black layers 16 are formed on a surface of the second substrate 4 facing the first substrate 2, and an anode electrode 18 is formed on the phosphor layers 14 and the black layers 16 with a metallic material, such as aluminum. The anode electrode 18 receives a high voltage required for accelerating the electron beams, and reflects the visible rays radiated from the phosphor layers 14 toward the first substrate 2 to the second substrate 4, thereby increasing the screen brightness.

Meanwhile, the anode electrode 18 may be formed with a transparent conductive material, such as indium tin oxide (ITO), instead of the metallic material. In this case, the anode electrode 18 may be placed on a surface of the phosphor layers 14 and the black layers 16 facing the second substrate, and patterned with a plurality of separate portions.

Spacers 20 are arranged between the first and second substrates 2 and 4, and the first and second substrates 2 and 4 are sealed to each other at their peripheries using a sealant, such as a glass frit with a low melting point. The inner space between the first and second substrates 2 and 4 is exhausted to be in a vacuum state, thereby constructing an electron emission device. The spacers 20 are located corresponding to the non-light emission regions where the black layers 16 are placed.

The above-structured electron emission device is driven by applying predetermined voltages to the cathode electrodes 6, the gate electrodes 10, and the anode electrode 18. For instance, a scanning signal voltage is applied to one of the cathode and the gate electrodes 6 and 10, and a data signal voltage is applied to the other electrode. A positive (+) direct current (DC) voltage of several hundreds to several thousands of volts is applied to the anode electrode 18.

In pixels where the voltage difference between the cathode and the gate electrodes 6 and 10 exceeds the threshold value, electric fields are formed around the electron emission regions 12, and electrons are emitted from the electron emission regions 12. The emitted electrons are attracted by the high voltage applied to the anode electrode 18, and collide against the corresponding phosphor layers 14, thereby causing them to emit light.

This embodiment of the electron emission device has an optimized internal structure in consideration of the factors influencing the potential distribution such that an even potential distribution is made around the gate electrodes 10 over the electron emission regions 12.

As explained previously, the potential distribution depends upon the voltages applied to the respective electrodes, and the shape characteristic of the internal structure, particularly upon the inter-electrode distance. That is, the potential distribution mainly depends upon the cathode voltage, the gate voltage, the anode voltage, the distance between the cathode and the gate electrodes 6 and 10, and the distance between the cathode and the anode electrodes 6 and 18.

However, among the factors determining the potential distribution, one of the cathode voltage and the gate voltage forms the scanning signal voltage, and the other forms the data signal voltage, thereby controlling the amount of electric current per respective pixels. Therefore, the cathode and the gate voltages are mainly determined in view of the driving requirements. The anode voltage is mainly determined in view of brightness requirements, as the screen brightness depends thereupon. The distance between the cathode and the gate electrodes 6 and 10 is determined by the thickness of the insulating layer 8, which is in turn determined by processing capacities, such as the voltage that the two electrodes can withstand between them, and processing ease.

Accordingly, in consideration of the four factors, the distance between the cathode and the anode electrodes 6 and 18 is optimized, thereby obtaining an even potential distribution.

With the electron emission device according to the present embodiment, the distance z between the cathode and the anode electrodes 6 and 18 is established to satisfy the following condition ("formula 1"):

$$0.7d((Va-Vc)/Vg) \leqq z \leqq 1.4d((Va-Vc)/Vg) \quad (1)$$

where Vc indicates the cathode voltage, Vg the gate voltage, Va the anode voltage, and d the distance between the cathode and the gate electrodes 6 and 10. The voltages Vc, Vg, and Va are expressed by the unit of volts (V), and the distances d and z by the unit of micrometers (μm).

According to formula 1, a substantially even potential distribution where the distortion degree of the electronic lens is 20% or less is realized at the openings 10*a* of the gate electrodes 10 over the electron emission regions 12 during the driving of the electron emission device, irrespective of the driving conditions of the cathode and the gate electrodes 6 and 10 and the shape of the structures formed on the first substrate 2.

Figure 3:
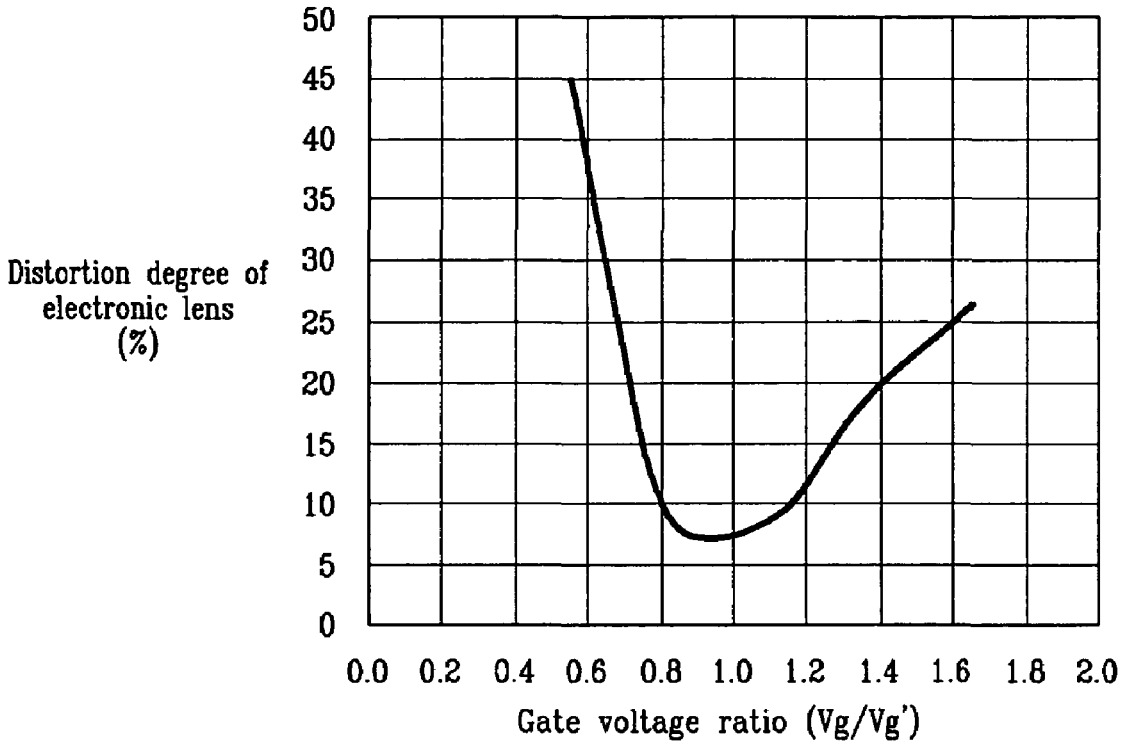
FIG. 3 is a graph illustrating the variation in the distortion of an electronic lens as a function of a gate voltage ratio.

With the graph illustrated in FIG. 3, the vertical axis is the distortion degree of the electronic lens, which represents the potential difference made around the gate electrodes. The distortion degree of the electronic lens is defined by the following formula ("formula 2"):

$$\text{distortion degree of electronic lens} = |Vcenter - Vg|/Vg, \quad (2)$$

where Vcenter indicates the electric potential at the center of the opening portion of the gate electrode.

The horizontal axis of the graph is the gate voltage ratio defined by Vg/Vg', which is the ratio of the actually applied gate voltage Vg to the ideal gate voltage Vg'. The ideal gate voltage Vg' is defined by the following formula ("formula 3"):

$$Vg' = (Va - Vc) \times d/z \quad (3)$$

Formula 4 is derived from formula 3.

$$z = ((Va - Vc)/Vg')d \quad (4)$$

As known from the result of FIG. 3, within the range where the distance z between the cathode and the anode electrodes satisfies the condition of formula 1, that is, within the range where the gate voltage ratio of Vg/Vg' is 0.7-1.4, the distortion degree of the electronic lens turned out to be 20% or less. Within the distortion degree of the electronic lens of 20% or less, when electrons are emitted from the electron emission regions, the diffusion angle of the electrons (the angle measured from the normal line of the first substrate) is about 3° or less, which means the electron beams possess excellent straightness.

An electron emission device according to one example ("Example 1") satisfying the condition of formula 1, an electron emission device according to a Comparative Example 1, where the distance z between the cathode and the anode electrodes exceeds 1.4d((Va−Vc)/Vg), and an electron emission device according to a Comparative Example 2, where the distance z between the cathode and the anode electrodes is less than 0.7d((Va−Vc)/Vg) were fabricated. The potential distribution and the trajectories of the emitted electron beams in those electron emission devices were tested.

The driving conditions in Example 1 were established such that the cathode voltage Vc was 0V, the gate voltage Vg was 80V, the anode voltage Va was 8 kV, the distance d between the cathode and the gate electrodes was 15 μm, and the distance between the cathode and the anode electrodes was 1500 μm.

Figure 4A:
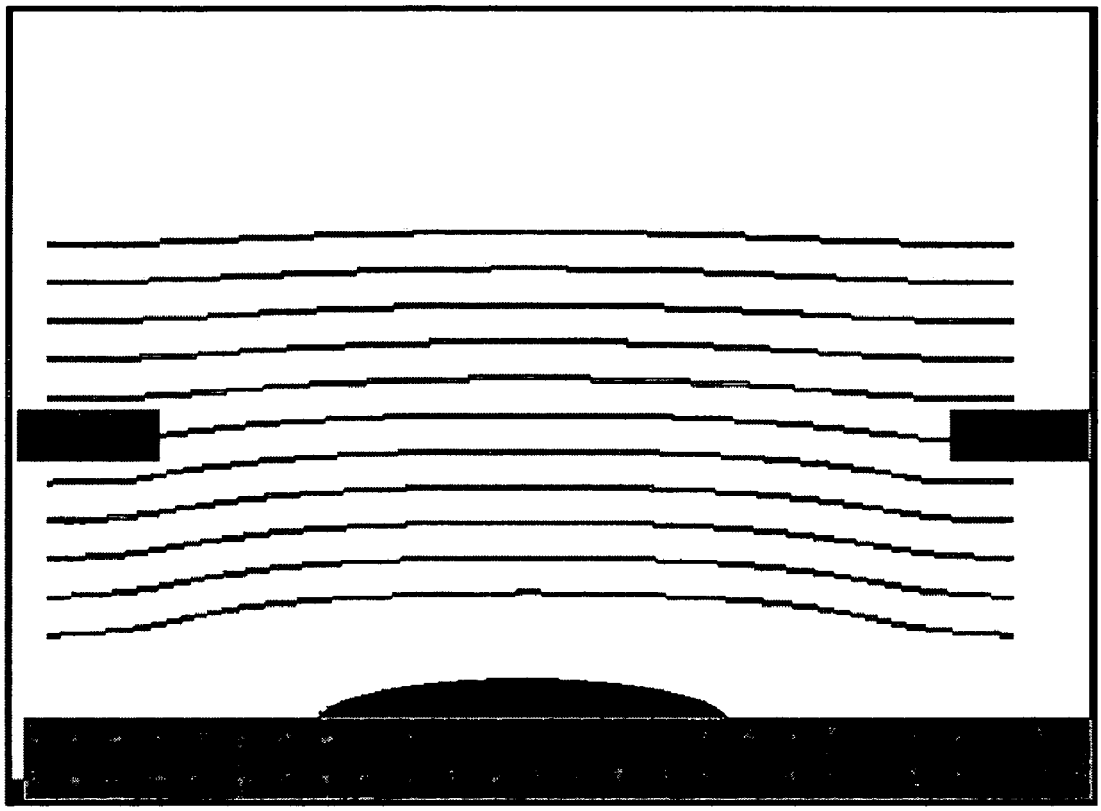
FIG. 4A schematically illustrates the potential distribution around the electron emission regions during the operation of an electron emission device according to an Example 1.
Figure 4B:
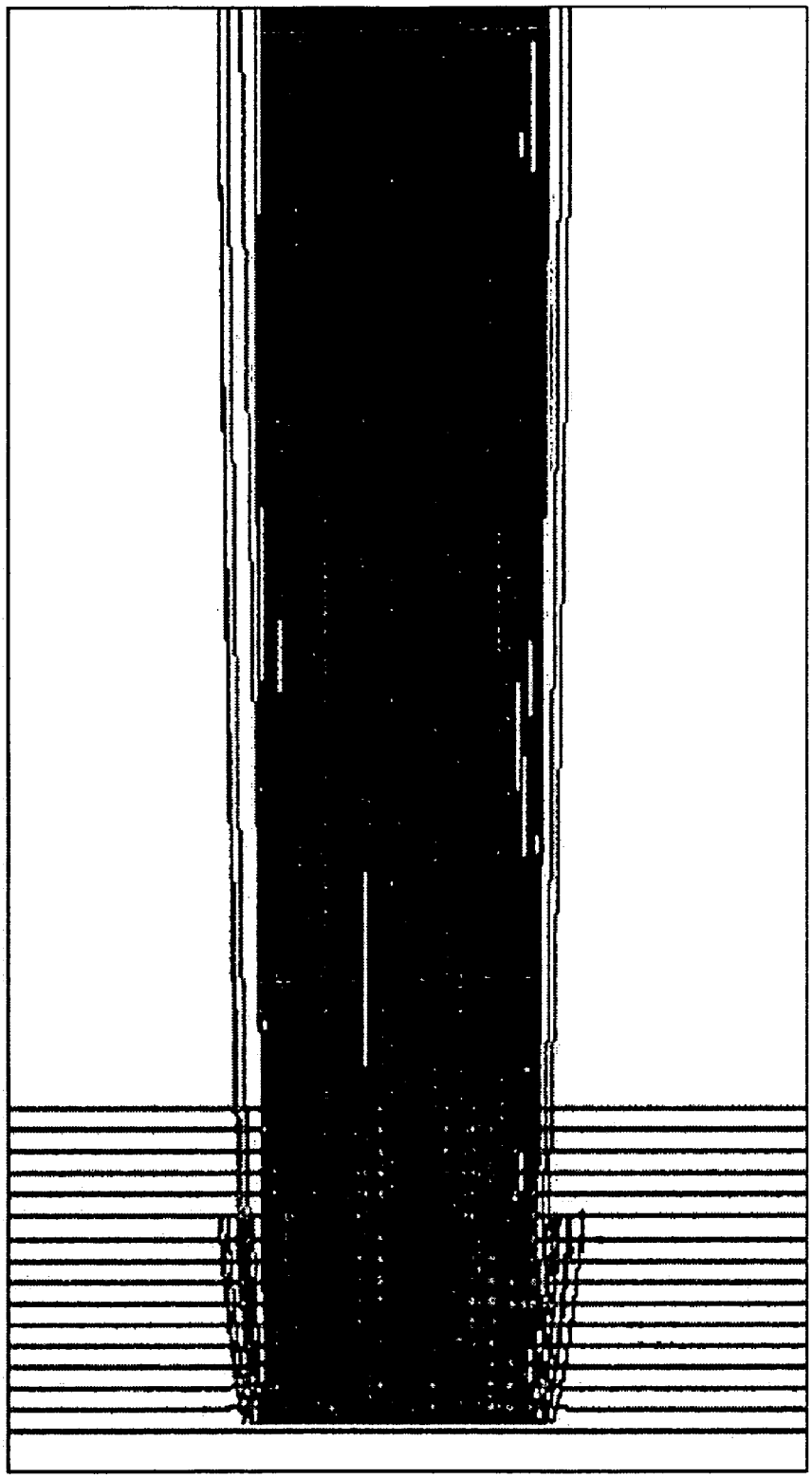
FIG. 4B schematically illustrates the trajectories of electron beams emitted during the operation of the electron emission device according to the Example 1.

As shown in FIG. 4A, equipotential lines proceeding parallel to the top surface of the first substrate over the electron emission regions during the driving of the electron emission device are evenly spaced apart from each other by a predetermined distance, thereby making an even potential distribution. Accordingly, as shown in FIG. 4B, the electrons emitted from the electron emission regions are straightly migrated toward the second substrate substantially without the beam spreading.

In the Comparative Example 1, the cathode voltage Vc, the gate voltage Vg, the anode voltage Va, and the distance d between the cathode and the gate electrodes were established to be the same as those related to Example 1. The distance z between the cathode and the anode electrodes was established to be 2400 μm.

Figure 5A:
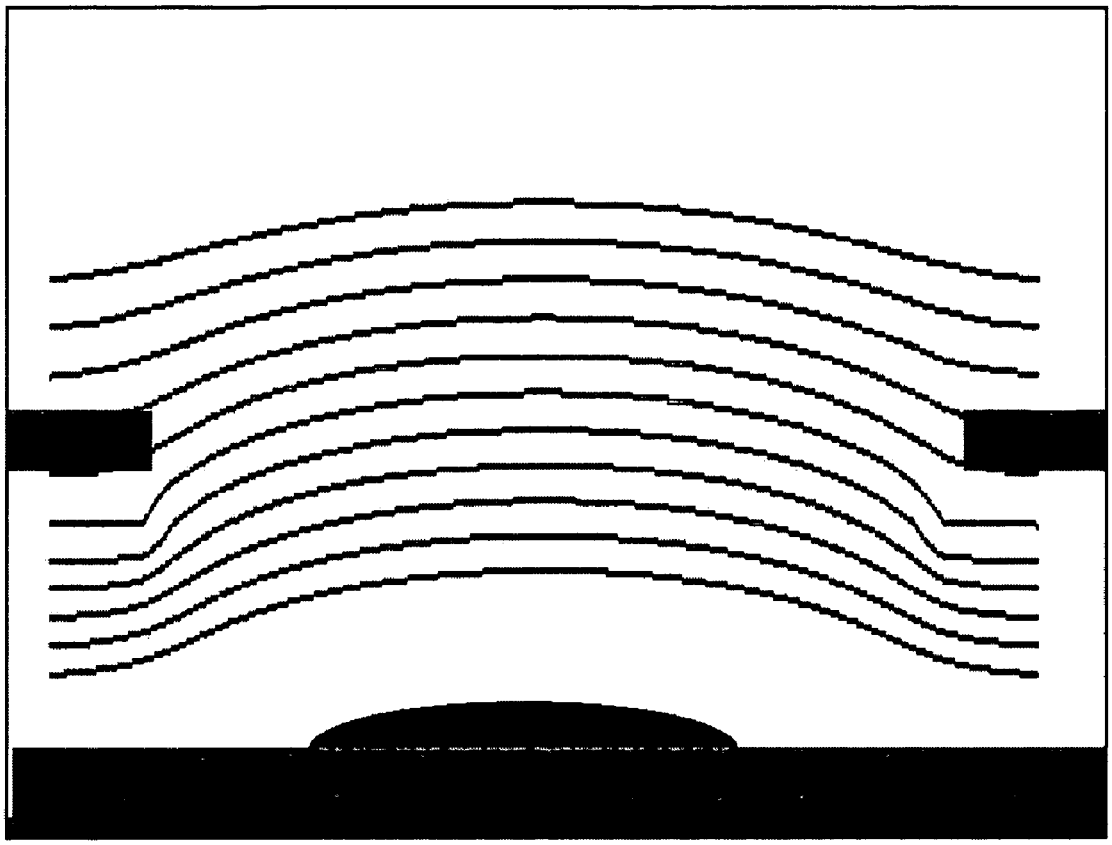
FIG. 5A schematically illustrates the potential distribution around the electron emission regions during the operation of an electron emission device according to a Comparative Example 1.
Figure 5B:
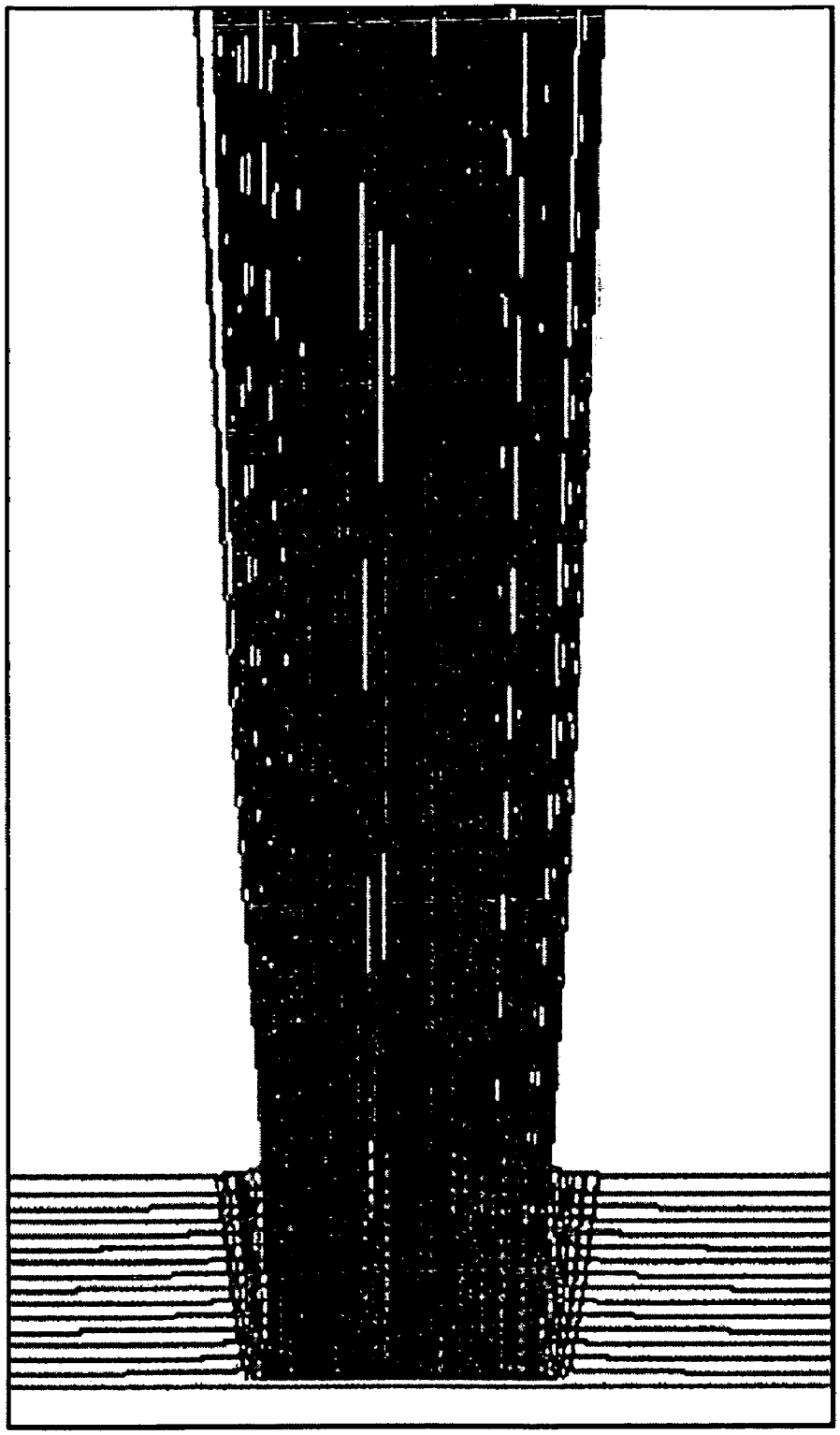
FIG. 5B schematically illustrates the trajectories of electron beams emitted during the operation of the electron emission device according to the Comparative Example 1.

As shown in FIG. 5A, during the operation of the electron emission device according to the Comparative Example 1, convex equipotential lines directed toward the anode were formed over the electron emission regions. Consequently, as shown in FIG. 5B, when electrons were migrated toward the second substrate, a considerable beam spreading occurred.

In the Comparative Example 2, the cathode voltage Vc, the gate voltage Vg, the anode voltage Va, and the distance d between the cathode and the gate electrodes were established to be the same as those related to Example 1. The distance z between the cathode and the anode electrodes was established to be 750 μm.

Figure 6A:
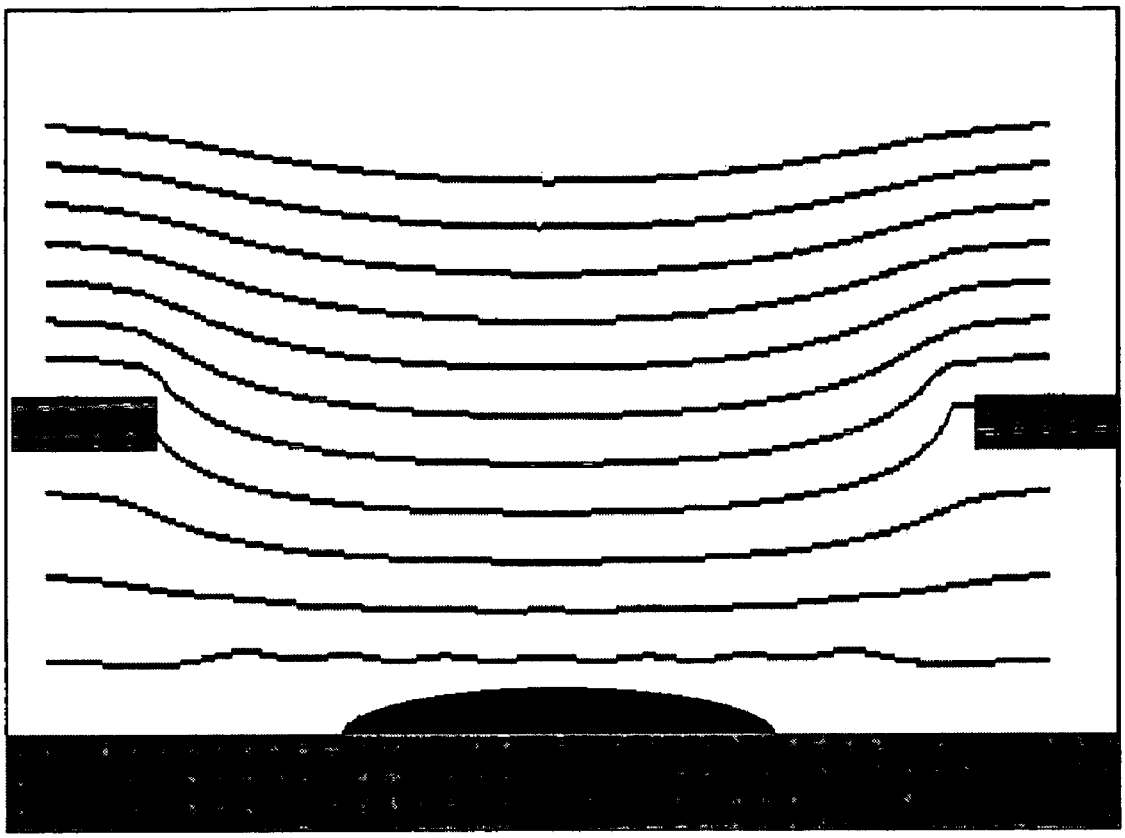
FIG. 6A schematically illustrates the potential distribution around the electron emission regions during the operation of an electron emission device according to a Comparative Example 2.
Figure 6B:
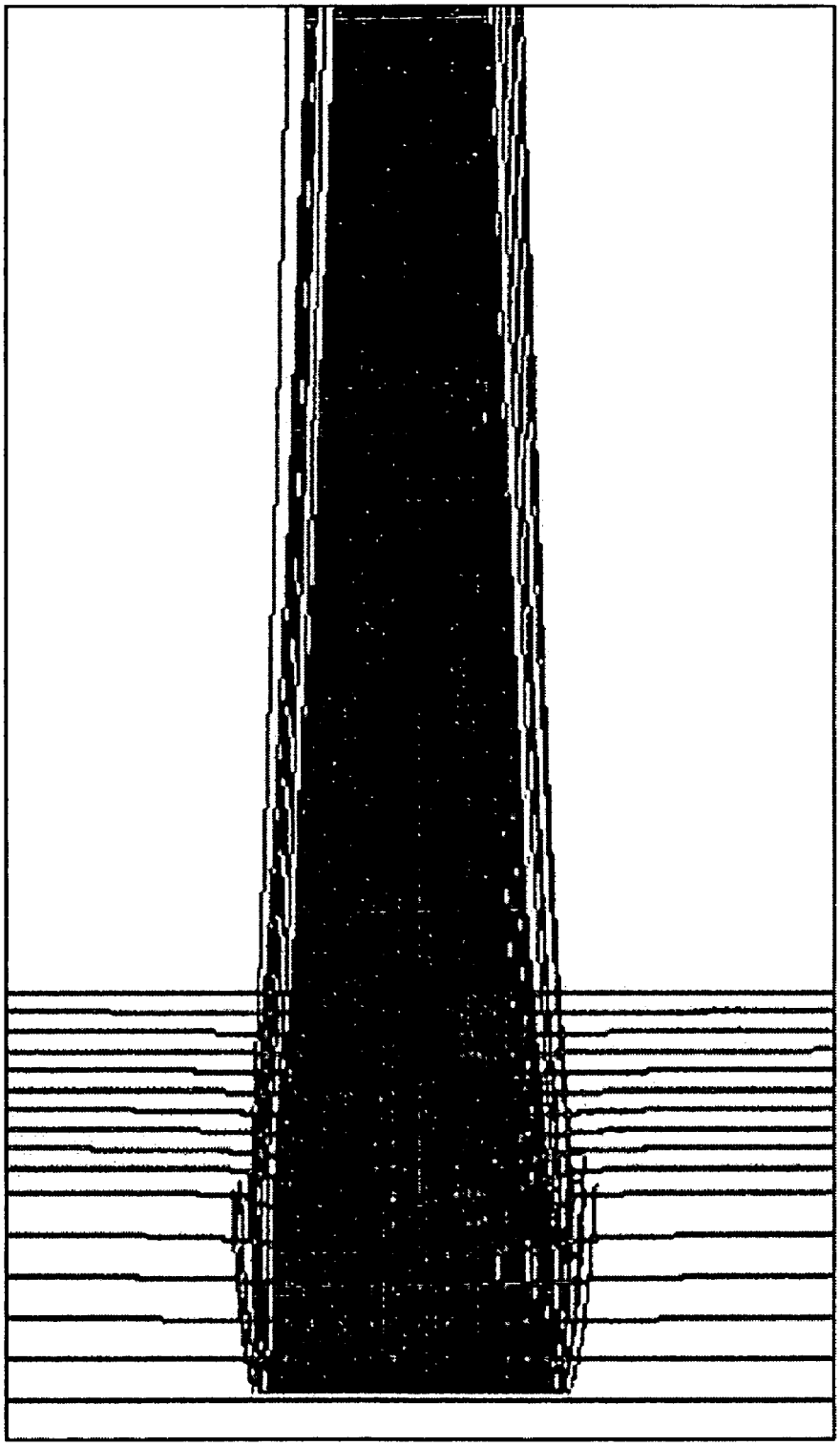
FIG. 6B schematically illustrates the trajectories of electron beams emitted around the electron emission regions during the operation of the electron emission device according to the Comparative Example 2.
Figure 6C:
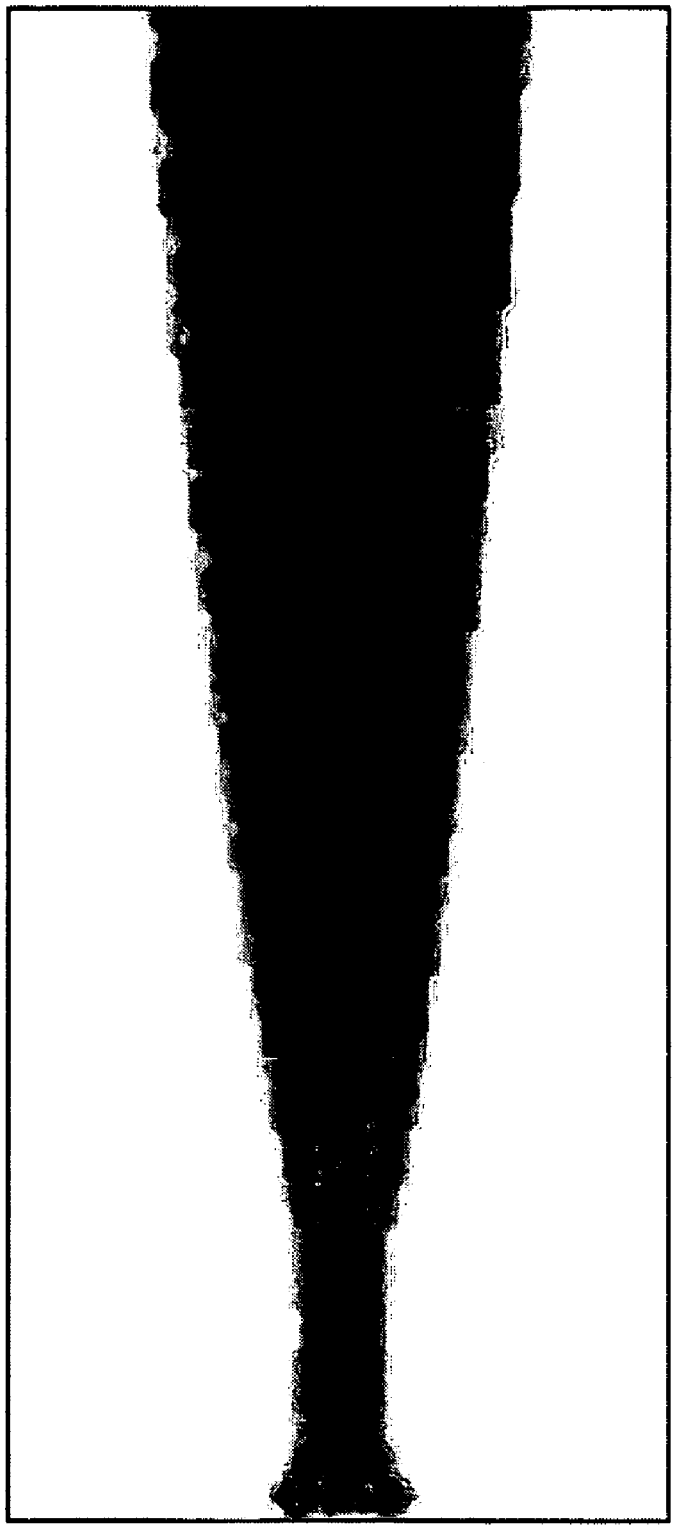
FIG. 6C schematically illustrates the trajectories of electron beams emitted during the operation of the electron emission device according to the Comparative Example 2.

As shown in FIG. 6A, during the operation of the electron emission device according to the Comparative Example 2, concave equipotential lines directed toward the anode were formed over the electron emission regions. Consequently, as shown in FIG. 6B, electrons were focused while passing through the gate electrodes, but then became over-focused. When the electrons reached the phosphor layers, a considerable beam spreading occurred. FIG. 6B illustrates the focused state of the electrons. When the electrons were further migrated toward the phosphor layers, the beam spreading occurred at a predetermined location, as shown in FIG. 6C.

As described above, with the electron emission device according to the embodiment of the present invention, the distance between the cathode and the anode electrodes 6 and 18 is controlled irrespective of the driving conditions of the electron emission device or the shape of the structure of the first substrate 2, thereby obtaining an even potential distribution during the driving of the electron emission device.

The distance between the cathode and the anode electrodes 6 and 18 is determined by the distance between the first and second substrates 2 and 4. That is, the inter-electrode distance derived from formula 1 is substantially made by the distance between the two substrates during the fabrication of the electron emission device. Further, the cathode electrodes 6, the anode electrode 18, and the phosphor layers 14 have a thickness of several hundred to several thousand angstroms Å (1 Å=$10^{-10}$ m), which is extremely small compared to the distance between the first and second substrates 2 and 4. The distance z between the cathode and the anode electrodes 6 and 18 approximates the distance between the first and second substrates 2 and 4. Accordingly, when the distance between the first and second substrates 2 and 4 is indicated by z', formula 1 may be expressed by the following formula:

$$0.7d((Va-Vc)/Vg) \leqq z' \leqq 1.4d((Va-Vc)/Vg) \quad (5)$$

As described above, in various embodiments of electron emission devices according to the present invention, the distance between the cathode and the anode electrodes is optimized, so that an even potential distribution is made during the operation of the electron emission device. The electrons emitted from the electron emission regions are straightly migrated toward the second substrate while minimizing beam spreading, so that they land on the corresponding phosphor layers, thereby causing them to light emit. Consequently, with the inventive electron emission device, the display quality is enhanced with a high resolution.

Although exemplary embodiments of the present invention have been described in detail hereinabove, it should be clearly understood that many variations and/or modifications of the basic inventive concept herein taught which may appear to those skilled in the art will still fall within the spirit and scope of the present invention, as defined in the appended claims and their equivalents.

What is claimed is:

1. An electron emission device comprising:

a first substrate;

a second substrate facing the first substrate;

cathode electrodes formed on the first substrate;

electron emission regions formed on the cathode electrodes;

an insulating layer and gate electrodes formed on the cathode electrodes and having openings exposing the electron emission regions;

phosphor layers formed on the second substrate; and an anode electrode formed on a surface of the phosphor layers, wherein the distance z between the cathode and the anode electrodes satisfies the following condition:

$$0.7d((Va-Vc)/Vg) \leqq z \leqq 1.4d((Va-Vc)/Vg),$$

where Vc indicates the voltage applied to the cathode electrodes, Vg is the voltage applied to the gate electrodes, Va is the voltage applied to the anode electrode, and d is the distance between the cathode and the gate electrodes, and wherein Vc, Vg, and Va are expressed by the unit of volts (V), and d and z by the unit of micrometers (μm).

2. The electron emission device of claim 1, wherein the cathode and the gate electrodes are perpendicular to each other and cross in crossed regions, and one or more electron emission regions are provided per respective crossed regions of the cathode and gate electrodes.

3. The electron emission device of claim 1, wherein the electron emission regions comprise at least one material selected from the group consisting of carbon nanotube, graphite, graphite nanofiber, diamond, diamond-like carbon, $C_{60}$, and silicon nanowire.

4. The electron emission device of claim 1, wherein the anode electrode is formed on a surface of the phosphor layers that faces the first substrate, and is formed with a metallic material.

5. The electron emission device of claim 1, wherein the distance z is in the range from 1050 μm to 2100 μm when d=15 μm, Va=8 kV, Vg=80V and Vc=0V.

6. The electron emission device of claim 1, wherein a distortion degree of an electronic lens formed by the gate electrodes is 20% or less.

7. The electron emission device of claim 1, wherein a diffusion angle of the electrons is about 3 degrees or less.

8. An electron emission device comprising:

a first substrate;

a second substrate facing the first substrate;

cathode electrodes formed on the first substrate;

electron emission regions formed on the cathode electrodes;

an insulating layer and gate electrodes formed on the cathode electrodes and having openings exposing the electron emission regions;

phosphor layers formed on the second substrate; and an anode electrode formed on a surface of the phosphor layers;

wherein the distance z' between the first and second substrates satisfies the following condition:

$$0.7d((Va-Vc)/Vg) \leqq z' \leqq 1.4d((Va-Vc)/Vg),$$

where Vc indicates the voltage applied to the cathode electrodes, Vg is the voltage applied to the gate electrodes, Va is voltage applied to the anode electrode, and d is the distance between the cathode and the gate electrodes, and wherein Vc, Vg, and Va are expressed by the unit of volts (V), and d and z' by the unit of micrometers (μm).

9. The electron emission device of claim 8, wherein the cathode and the gate electrodes are perpendicular to each other and cross in crossed regions, and one or more electron emission regions are provided per respective crossed regions of the cathode and gate electrodes.

10. The electron emission device of claim 8, wherein the electron emission regions comprise at least one material selected from the group consisting of carbon nanotube, graphite, graphite nanofiber, diamond, diamond-like carbon, $C_{60}$, and silicon nanowire.

11. The electron emission device of claim 8, wherein the anode electrode is formed on a surface of the phosphor layers that faces the first substrate, and is formed with a metallic material.

12. The electron emission device of claim 8, wherein the distance z' is in the range from 1050 μm to 2100 μm when d=15 μm, Va=8 kV, Vg=80V and Vc=0V.

13. A method of driving an electron emission device comprising first and second substrates facing each other, cathode electrodes formed on the first substrate, electron emission regions formed on the cathode electrodes, an insulating layer and gate electrodes formed on the cathode electrodes and having openings exposing the electron emission regions, the gate electrodes being spaced apart from the cathode electrodes at a distance d, phosphor layers formed on the second substrate, and an anode electrode formed on a surface of the phosphor layers, the method comprising:

applying a voltage Vc to the cathode electrodes to emit electrons from the electron emission regions;

applying a voltage Va to the anode electrodes to accelerate the emitted electrons toward the second substrate; and applying a voltage Vg to the gate electrodes to focus the emitted electrons, wherein the voltage Vg is between $0.7\times(d/z)\times(Va-Vc)$ and $1.4\times(d/z)\times(Va-Vc)$, and wherein z is a distance between the anode electrode and the cathode electrodes or a distance between the first and second substrates, and wherein Vc, Vg, and Va are expressed by the unit of volts (V), and d and z by the unit of micrometers (μm).

14. The method of claim 13, wherein a distortion degree of an electronic lens formed by the gate electrodes is 20% or less.

15. The method of claim 13, wherein a diffusion angle of the electrons is about 3 degrees or less.

* * * * *